United States Patent [19]

Spiegel

[11] Patent Number: 4,823,412

[45] Date of Patent: Apr. 25, 1989

[54] COMMODE CHAIR WITH PAIL AND SEAT SUPPORT

[75] Inventor: Alan M. Spiegel, New Rochelle, N.Y.

[73] Assignee: Temco Home Health Care Products, Inc., Passaic, N.J.

[21] Appl. No.: 90,779

[22] Filed: Aug. 28, 1987

[51] Int. Cl.[4] ..... A47K 13/26

[52] U.S. Cl. ..... 4/483; 4/240

[58] Field of Search ..... 4/483, 465, 476, 479, 4/480, 293, 236, 240

[56] References Cited

U.S. PATENT DOCUMENTS

| | | | |
|---|---|---|---|
| 3,795,923 | 3/1974 | Thomas | 4/483 |
| 3,829,908 | 8/1974 | Thomas | 4/483 |
| 3,854,773 | 12/1974 | Thomas | 297/417 |
| 4,287,619 | 9/1981 | Brewer et al. | 4/483 |
| 4,592,097 | 6/1986 | Zimmerman | 4/251 |

*Primary Examiner*—A. D. Pellinen
*Assistant Examiner*—Morris Ginsburg
*Attorney, Agent, or Firm*—Richard C. Woodbridge

[57] ABSTRACT

An improved commode with a removable receptacle is provided with a chair portion, front and rear legs, and horizontal braces extending between the front legs and the rear legs, respectively. The rear brace is adapted for mounting a hinged toilet seat thereto. A novel support structure connects the rear brace to the front brace. The support structure includes two substantially parallel flat bars each having a raised portion extending above the rear brace for supporting the underside of the toilet seat near the rear brace. The support structure also includes a contoured widened opening for retaining a pail between the raised supporting portion and the front brace.

5 Claims, 4 Drawing Sheets

10 FIG. 2

COMMODE CHAIR WITH PAIL AND SEAT SUPPORT

BACKGROUND OF THE INVENTION

1. Field of the Invention

This invention relates to a, portable commode with a removable receptacle and a support structure for retaining a receptacle and providing support to the rear portion of a hinged toilet seat.

2. Background of the Related Art

Conventional portable commodes which include a frame for mounting a removable receptacle have several drawbacks. One difficulty with conventional wire or tubular frames is that the weight of the user on the commode causes deformation of the frame, so that the receptacle becomes wedged in the frame. This results in difficulties in separating the receptacle from the frame and even may cause breakage of the receptacle.

In addition, the need for a strong supporting structure requires excessive use of metal plates, wires and/or tubular bracing resulting in an increase in the weight of the commode structure and an increase production costs. See, for example, U.S. Pat. No. 4,287,619 issued to Brewer, et al.

One contemplated solution is illustrated in U.S. Pat. Nos. 3,795,923, 3,829,908 and 3,854,773 all issued to Morton I. Thomas on Mar. 12, Aug. 20 and Dec. 17, 1974, respectively (the "Thomas patents"). The Thomas patents teach the use of a wire frame made from two parallel sections mounted to the front and rear portions of the commode. Specifically, the wire frame hooks onto two horizontal braces which hold together the front, and rear legs of the commode, respectively. The wire frame is mounted to the braces under tension so as to exert a tight gripping force on the forward and rear portions of the commode. The tensioned wire frame includes two arcuate wires welded to the parallel wire sections to support a pail or similar receptacle. The tensioned wire frame attached to the tubular commode frame adds structural rigidity to the commode and allows for lighter gauge metal and less cross bracing to be used in the construction of a portable commode.

Other portable commodes constructed under the teachings of the Thomas patents substituted curved tubular frames or flat metal frames for the wire frames. These were welded or riveted to the horizontal braces.

The commodes which use the wire frames taught by the Thomas patents and the commodes which substituted the curved tubular or flat metal frames for the wire frames have one specific drawback. Although the frames are structurally stable and rigid, and while the front portion of the toilet seat is adequately supported by the front horizontal brace, the rear portion of the toilet seat which supports most of the user's weight is only supported by the hinges which attach the rear of the toilet seat to the rear horizontal brace. Most commercially available toilet seats are made to be supported, both in front and in the rear, by a solid porcelain toilet bowl. However, as explained above, when these toilet seats are used on portable commodes, there is no support for the rear portion of the toilet seat, so that most of the user's weight is transferred to the hinges which were not designed to support the weight of the user. Consequently, the hinges of the commodes have been subject to the excessive wear which results in the distortion of the hinges, movement of the seat and discomfort to the user, eventually resulting in the breakage of the hinges. The excessive wear and breakage of the toilet seat hinges of portable commodes has caused concern over the safety of the infirm and the disabled who are the primary users of portable commodes.

SUMMARY OF THE INVENTION

The present invention describes an improved commode with a removable receptacle. The commode has a chair portion, front and rear legs, and horizontal braces extending between the front legs and the rear legs, respectively. The rear brace is adapted for mounting a hinged toilet seat thereto.

A novel support structure connects the rear brace to the front brace. The support structure includes two substantially parallel flat metal bars each having a raised portion extending above the rear brace for supporting the underside of the toilet seat near the rear brace. One end of each flat bar is attached to the top of the rear brace and the other ends are attached to the bottom of the front brace. The support structure also includes a contoured, widened opening for retaining a pail between the raised supporting portion and the front brace. The novel support structure thus provides added support to the rear portion of the toilet seat which carries a large portion of the user's weight. The frame also adds structural strength to the commode by providing a strong and resilient connection between the front and rear braces.

DETAILED DESCRIPTION OF THE INVENTION

Figure 1:
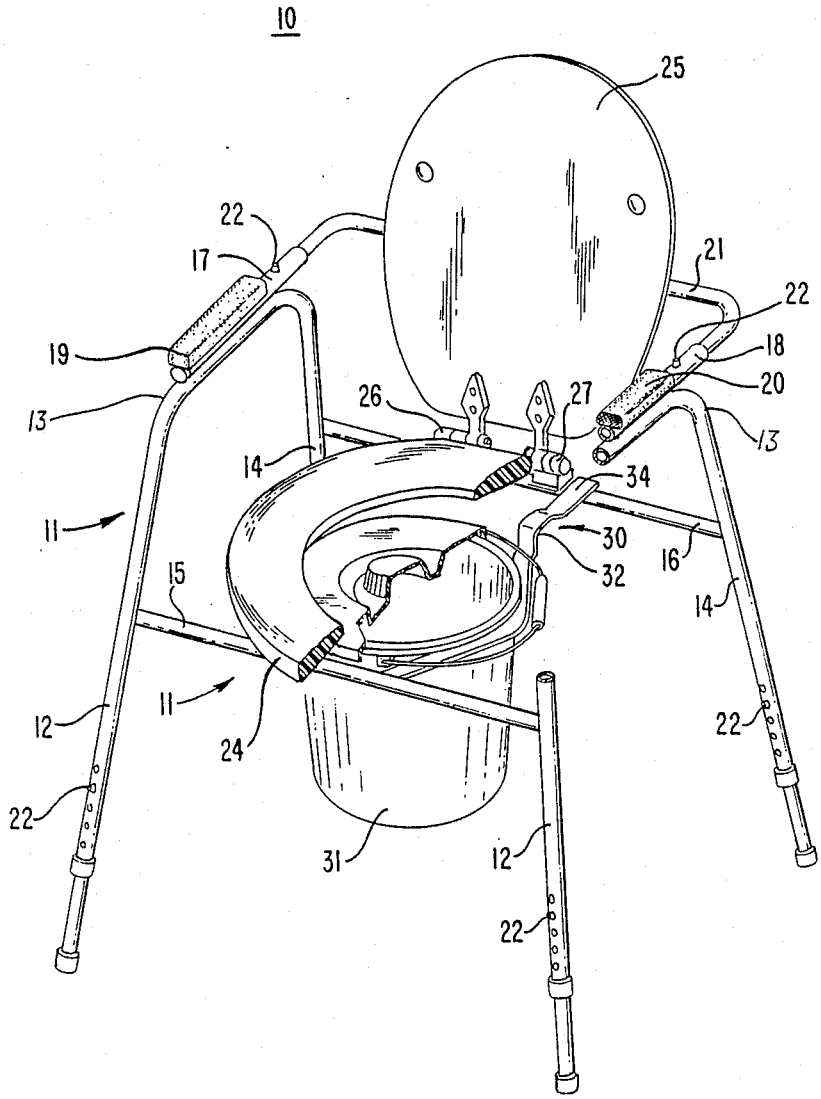
FIG. 1 is a perspective, partial cutaway view of a commode embodying this invention.
Figure 2:
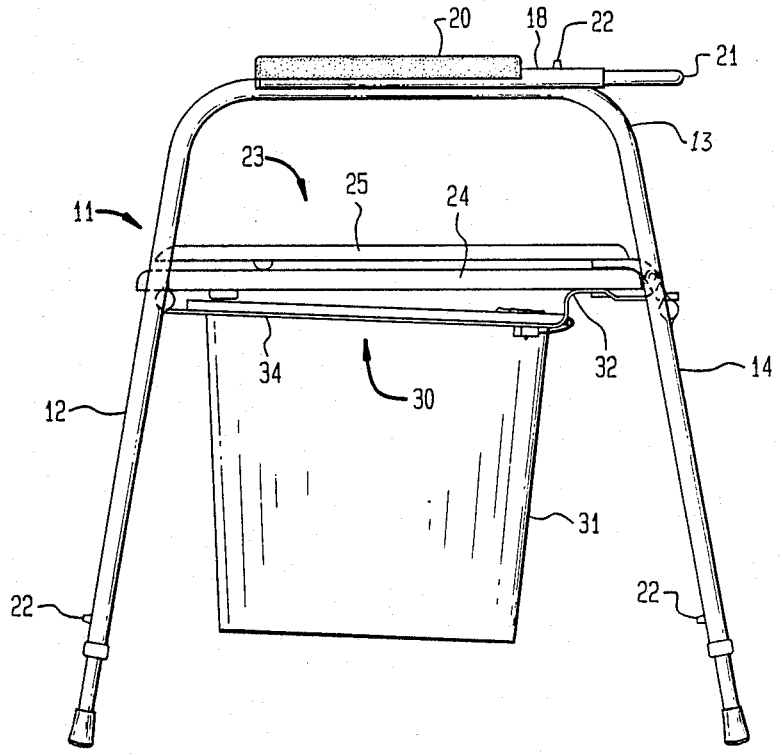
FIG. 2 is a side elevational view of the commode illustrated in FIG. 1 with the toilet seat cover lowered.
Figure 3:
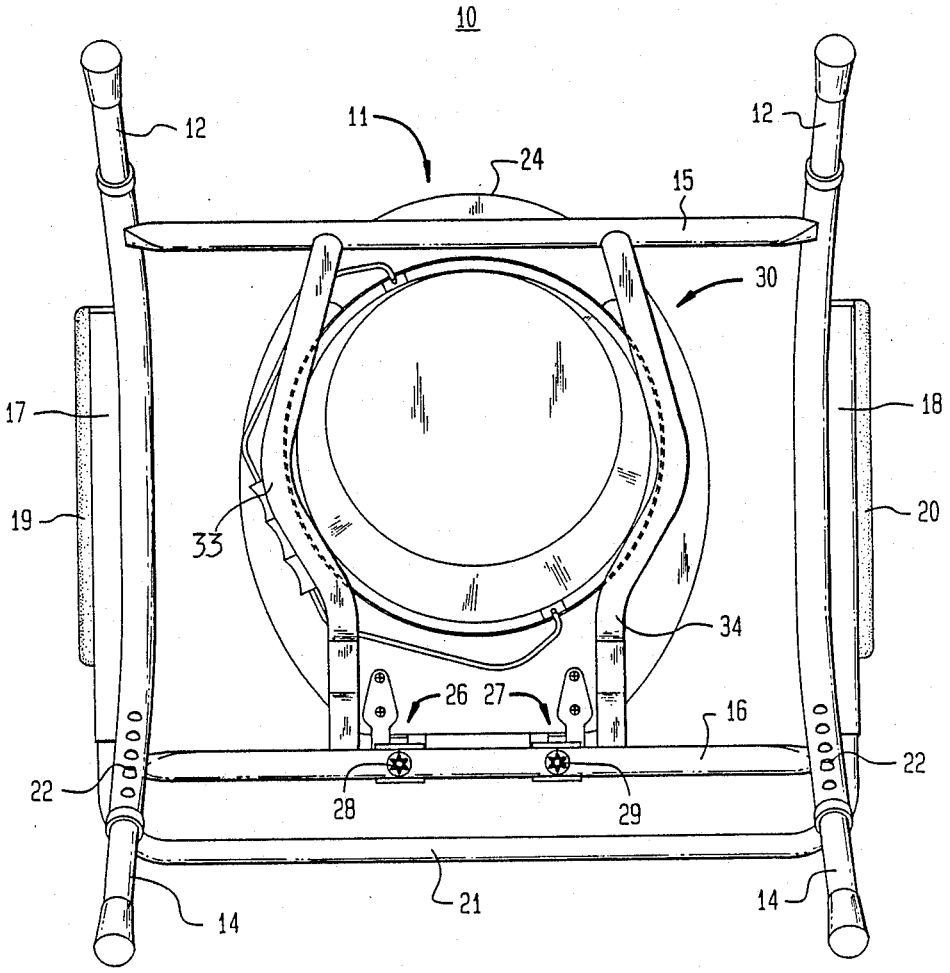
FIG. 3 is a bottom plan view of the commode illustrated in FIG. 1.
Figure 4:
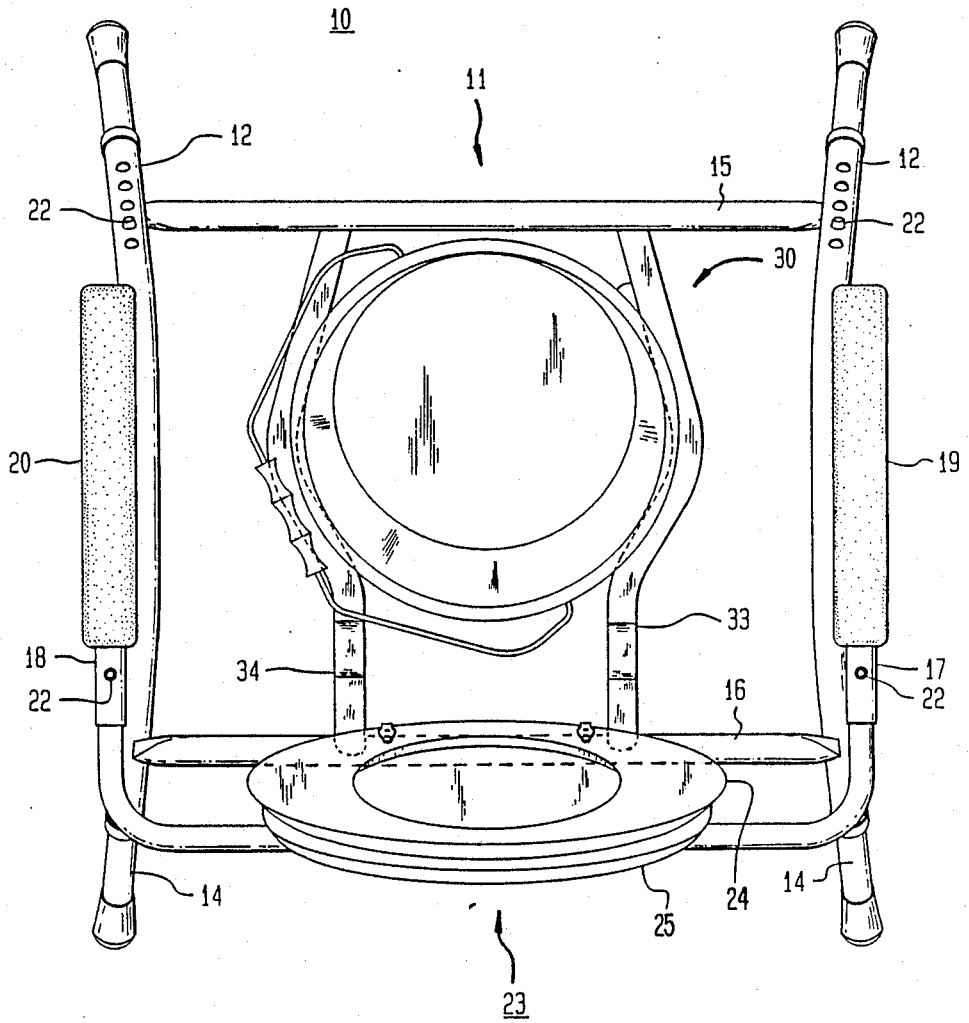
FIG. 4 is a top plan view of the commode illustrated in FIG. 1 with the toilet seat and cover raised.

According to the present invention, the preferred commode 10, with a removable receptacle 31 illustrated in FIGS. 1–4 includes a chair structure 11 formed of metal tubing, i.e., chromed plated steel tubing or tubular aluminum. The metal tubing is suitably bent to provide front legs 12, side portions 13 and rear legs 14. The front legs 12 are interconnected by a horizontal brace 15 which is welded to the front legs in the embodiment illustrated herein. In a commode constructed from tubular aluminum, the horizontal brace is bolted or riveted to the front legs. The rear legs 14 are suitably interconnected by a rear horizontal brace 16. Also included are tubular metal armrest supports 17, 18, armrests 19, 20 and removable U-shaped back rest.

The front legs 12 and rear legs 14 are telescopically adjustable in height. The telescoping tubular leg members 12, 14 and the removable U-shaped back rest 21 are connected by a push button connector 22 described in U.S. Pat. No. 3,947,140 issued to Morton I. Thomas, entitled CONNECTOR FOR TELESCOPING TUBULAR STICK MEMBERS.

A conventional, commercially available, toilet seat cover assembly is provided, including seat 24, cover 25 interpivoted on hinges 26, 27. The toilet seat cover assembly is secured to rear horizontal brace 16 by nylon bolts 28, 29.

A support structure 30 is provided for retaining a removable receptacle 31 under the seat 24. The support structure 30 includes a raised rear portion 32 for resiliently supporting the underside of the toilet seat near the rear horizontal brace 16. The support structure 30 also adds structural strength and rigidity to the commode 10 by providing a strong resilient connection between the front horizontal brace 15 and, rear horizontal brace 16.

Support structure 30 includes a pair of substantially parallel support members 33, 34. Support members 33, 34 are preferably constructed from contoured substantially flat chrome plated steel which is formed by bending and/or stamping into the shape illustrated in FIGS. 1–4. In the embodiment illustrated in the Figures, support members 33, 34 are welded to the front and rear horizontal braces 15, 16. However, in alternative embodiments, support members 33, 34 may also be riveted or bolted to front and rear horizontal braces 15, 16, especially when the commode 10 is constructed from aluminum and tubing. Also, the support members 33, 34 may be constructed from other materials such as aluminum or steel tubing, fiberglass, composites and the like.

It is preferred that the support members 33, 34 are attached to the top of the rear horizontal brace 16 and spaced on either side of the toilet seat cover 23 attachment points so that the support members 33, 34 do not interfere with the operation of the toilet seat's hinges 26, 27. Also, attaching the support members 33, 34 on top of the rear horizontal brace 16 allows the weight of the user to be supported by the brace, rather than by the weld, bolt or rivet connecting the support member to the brace. The support members 33, 34 are attached about perpendicular to rear horizontal brace 16 and approximately parallel to each other. A raised rear portion 32 extends along a portion of each support member 33, 34, respectively, so that it resiliently contacts the rear portion of the underside of toilet seat 24, near the horizontal brace 16. This arrangement allows the raised rear portion 32 of the support member to support the proportion of the weight of the user which is directed to the rear portion of the toilet seat 24. The remaining weight of the user is supported by the front of the toilet seat 24 which rests upon front horizontal brace 15. Accordingly, the major portion of the user's weight, which when using portable commodes prior to this invention had to be supported on the relatively weak and flexible nylon toilet seat hinges, is now easily supported on the strong, raised rear portion 32 of support members 33, 34 of support structure 30.

Support members 33, 34 bend downwardly to terminate the raised rear portion 32 prior to reaching the rear portion of the opening in the toilet seat 24. The support members 33, 34 are bent in a contour which follows the lines of the opening in toilet seat 24, allowing the support member to retain the removable receptacle 31. Support members 33, 34 are preferably attached to the bottom portion of front horizontal brace 15. Alternatively, the support members 33, 34 may be bent upwards and suitably attached to the inside, or to the top of front horizontal brace 15.

The novel support structure 30 of this invention adds needed support to the rear portion of the toilet seat 24 which must safely support a large portion of the user's weight. The support structure also adds structural strength to the commode by providing a strong and resilient connection between the front and rear horizontal braces 15, 16, respectively.

I claim:

1. In combination with a commode apparatus with a removable receptacle, including a chair portion having front and rear leg portions, a hinged toilet seat, horizontally extending front and rear brace members extending between said front leg portions and said rear leg portions, respectively, and said rear brace member adapted for mounting said hinged toilet seat thereto, the improvement comprising:

a support structure connecting said rear brace member to said front brace member which includes:

(i) a seat supporting portion including a raised portion for providing support to the rear portion of said toilet seat near said rear brace member, and, (ii) a receptacle supporting portion for retaining said removable receptacle between said seat supporting portion and said front brace member, whereby said support structure adds support to the rear portion of said toilet seat which carries a substantial portion of the user's weight.

2. The combination of claim 1, wherein said support structure comprises a pair of substantially parallel support members, each extending between said rear brace member to said front brace member and each including:

(i) said raised portion extending above said rear brace member for resiliently supporting the underside of the rear portion of said toilet seat near said rear brace member, and, (ii) said receptacle supporting portion including a widened opening between said support structure for retaining and supporting said receptacle.

3. The combination of claim 2, wherein said receptacle supporting portion, including a widened opening, engages said receptacle on both the underside of the upper portion of said receptacle and the sides of said receptacle such that it restricts downward movement of said receptacle through said widened opening and substantially restricts movement of said receptacle in a plane horizontal to said toilet seat.

4. The combination of claim 3, wherein said support members each comprise contoured, substantially flat bars.

5. The combination of claim 4, wherein one end of each said support member is fixedly attached to the top of said rear brace member and the other end of said support member is fixedly attached to the bottom of said front brace member.

* * * * *